US009180570B2

(12) United States Patent
Kerprich et al.

(10) Patent No.: US 9,180,570 B2
(45) Date of Patent: Nov. 10, 2015

(54) GROOVED CMP PAD

(75) Inventors: Robert Kerprich, Portland, OR (US); Karey Holland, North Plains, OR (US); Diane Scott, Portland, OR (US); Sudhanshu Misra, San Jose, CA (US)

(73) Assignee: NexPlanar Corporation, Hillsboro, OR (US)

( * ) Notice: Subject to any disclaimer, the term of this patent is extended or adjusted under 35 U.S.C. 154(b) by 823 days.

(21) Appl. No.: 12/381,709

(22) Filed: Mar. 16, 2009

(65) Prior Publication Data

US 2009/0311955 A1 Dec. 17, 2009

Related U.S. Application Data

(60) Provisional application No. 61/036,897, filed on Mar. 14, 2008.

(51) Int. Cl.
*B24B 37/00* (2012.01)
*B24B 37/26* (2012.01)

(52) U.S. Cl.
CPC ..... *B24B 37/26* (2013.01)

(58) Field of Classification Search
CPC ..... B24B 37/20; B24B 37/26
USPC ..... 451/285–290, 527–529
See application file for complete search history.

(56) References Cited

U.S. PATENT DOCUMENTS 1,862,103 A * 6/1932 Stratford ..... 451/529
5,020,283 A 6/1991 Tuttle
5,177,908 A 1/1993 Tuttle
5,212,910 A 5/1993 Breivogel et al.
5,216,843 A 6/1993 Breivogel et al.
5,297,364 A 3/1994 Tuttle
5,394,655 A 3/1995 Allen et al.
5,441,598 A 8/1995 Yu et al.
5,533,923 A 7/1996 Shamouilian et al.
5,609,719 A 3/1997 Hempel
5,645,469 A 7/1997 Burke et al.
5,650,039 A 7/1997 Talieh
5,690,540 A 11/1997 Elliott et al.
5,725,420 A 3/1998 Torii
5,778,481 A 7/1998 Amsdan et al.
5,842,910 A 12/1998 Krywanczyk et al.
5,882,251 A 3/1999 Berman et al.
5,888,121 A 3/1999 Kirchner et al.
5,899,799 A 5/1999 Tjaden et al.
5,921,855 A 7/1999 Osterheld et al.
5,984,769 A 11/1999 Bennett et al.
5,990,012 A 11/1999 Robinson et al.
6,019,666 A 2/2000 Roberts et al.
6,022,264 A 2/2000 Cook et al.
6,089,966 A 7/2000 Arai et al.
6,093,651 A 7/2000 Andideh et al.
6,120,366 A * 9/2000 Lin et al. ..... 451/550
6,135,856 A 10/2000 Tjaden et al.
6,159,088 A 12/2000 Nakajima
6,217,418 B1 4/2001 Lukanc et al.
6,238,271 B1 5/2001 Censa
(Continued)

*Primary Examiner* — Maurina Rachuba
(74) *Attorney, Agent, or Firm* — Blakely Sokoloff Taylor Zafman LLP

(57) ABSTRACT

CMP pads having novel groove configurations are described. For example, described herein are CMP pads comprising primary grooves, secondary grooves, a groove pattern center, and an optional terminal groove. The CMP pads may be made from polyurethane or poly (urethane-urea), and the grooves produced therein may be made by a method from the group consisting of molding, laser writing, water jet cutting, 3-D printing, thermoforming, vacuum forming, micro-contact printing, hot stamping, and mixtures thereof.

19 Claims, 8 Drawing Sheets

(56) References Cited

U.S. PATENT DOCUMENTS 6,241,596 B1 6/2001 Osterheld et al.
6,254,456 B1 7/2001 Kirchner
6,261,168 B1 7/2001 Jensen et al.
6,273,806 B1 8/2001 Bennett et al.
6,277,015 B1 8/2001 Robinson et al.
6,331,137 B1 12/2001 Raeder et al.
6,340,325 B1 1/2002 Chen et al.
6,354,930 B1 3/2002 Moore
6,364,749 B1 4/2002 Walker
6,390,891 B1 5/2002 Guha et al.
6,422,929 B1 7/2002 Jang et al.
6,439,989 B1 8/2002 Reinhardt et al.
6,488,575 B2 12/2002 Agarwal et al.
RE37,997 E 2/2003 Tuttle
6,520,843 B1 2/2003 Halley
6,520,847 B2 2/2003 Osterheld et al.
6,561,891 B2 5/2003 Eppert, Jr. et al.
6,585,579 B2 7/2003 Jensen et al.
6,602,123 B1 8/2003 Naujok
6,634,936 B2 10/2003 Jensen et al.
6,645,061 B1 11/2003 Bennett et al.
6,648,733 B2 11/2003 Roberts et al.
6,648,743 B1 11/2003 Burke et al.
6,656,019 B1 12/2003 Chen et al.
6,685,548 B2 2/2004 Chen et al.
6,699,115 B2 3/2004 Osterheld et al.
6,729,950 B2 5/2004 Park et al.
6,736,709 B1 5/2004 James et al.
6,749,485 B1 6/2004 James et al.
6,749,714 B1 6/2004 Ishikawa et al.
6,783,436 B1 8/2004 Muldowney
6,824,455 B2 11/2004 Osterheld et al.
6,843,711 B1 1/2005 Muldowney
6,863,599 B2 3/2005 Kramer
6,875,096 B2 4/2005 Park et al.
6,913,527 B2 7/2005 He
6,918,824 B2 7/2005 Marquardt et al.
6,932,687 B2 8/2005 Agarwal et al.
6,942,549 B2 9/2005 Khoury
D510,850 S 10/2005 Roler
6,951,506 B2 10/2005 Andideh et al.
6,951,510 B1 10/2005 Rodriguez et al.
6,955,587 B2 10/2005 Muldowney
6,958,002 B1 10/2005 Palaparthi et al.
6,974,372 B1 12/2005 Muldowney
6,997,793 B1 2/2006 Ito
7,018,274 B2 3/2006 Muldowney
7,059,948 B2 6/2006 Li et al.
7,059,949 B1 6/2006 Elmufdi et al.
7,059,950 B1 6/2006 Muldowney
7,070,480 B2 7/2006 Moon et al.
7,090,572 B2 8/2006 Ito
7,097,550 B2 8/2006 Kawahara et al.
7,108,597 B2 9/2006 Muldowney
7,121,938 B2 10/2006 Suzuki
7,125,318 B2 * 10/2006 Muldowney ..... 451/41
7,131,895 B2 11/2006 Elmufdi et al.
7,131,901 B2 11/2006 Shih et al.
7,132,070 B2 11/2006 Shih et al.
7,140,955 B2 * 11/2006 Nabeya ..... 451/287
7,156,721 B2 1/2007 Palaparthi
7,179,159 B2 2/2007 Bonner et al.
7,182,677 B2 2/2007 Donohue et al.
7,226,345 B1 6/2007 Dornfeld et al.
7,229,341 B2 6/2007 Choi
7,234,224 B1 * 6/2007 Naugler et al. ..... 29/557
7,238,097 B2 7/2007 Ohno et al.
7,252,582 B2 8/2007 Renteln
7,255,633 B2 8/2007 Muldowney
7,258,602 B2 8/2007 Shih et al.
7,267,610 B1 9/2007 Elmufdi et al.
7,270,595 B2 9/2007 Elmufdi et al.
7,285,233 B2 10/2007 Shih et al.
7,300,340 B1 * 11/2007 Elmufdi et al. ..... 451/527
7,311,590 B1 12/2007 Muldowney
D559,063 S 1/2008 Okamoto et al.
D559,064 S 1/2008 Okamoto et al.
D559,065 S 1/2008 Miyauchi et al.
D559,066 S * 1/2008 Tano et al. ..... D8/70
D559,648 S 1/2008 Miyauchi et al.
D560,457 S 1/2008 Miyauchi et al.
7,314,402 B2 1/2008 Laursen et al.
7,329,174 B2 * 2/2008 Hosaka et al. ..... 451/527
7,357,698 B2 4/2008 Choi
7,357,703 B2 * 4/2008 Nishimura et al. ..... 451/527
7,364,497 B2 4/2008 Park et al.
7,377,840 B2 5/2008 Deopura et al.
D576,855 S 9/2008 Okamoto et al.
7,425,172 B2 9/2008 Misra et al.
7,429,207 B2 9/2008 Swedek et al.
7,429,210 B2 9/2008 Bonner et al.
D581,237 S 11/2008 Okamoto et al.
D584,591 S 1/2009 Tano et al.
7,516,536 B2 4/2009 Suzuki
7,520,796 B2 4/2009 Muldowney
7,520,798 B2 4/2009 Muldowney
D592,029 S 5/2009 Tano et al.
D592,030 S 5/2009 Tano et al.
7,534,162 B2 5/2009 Bottema et al.
7,544,115 B2 6/2009 O'Moore
D600,989 S 9/2009 Tano et al.
7,591,713 B2 9/2009 Soeta
7,601,050 B2 10/2009 Zuniga et al.
7,648,410 B2 1/2010 Choi
7,662,028 B2 2/2010 Feng et al.
2002/0068516 A1 6/2002 Chen et al.
2002/0077053 A1 6/2002 Pham
2003/0236055 A1 12/2003 Swedek et al.
2004/0014413 A1 1/2004 Kawahashi et al.
2004/0266326 A1 12/2004 Shiho et al.
2005/0153633 A1 7/2005 Shibuki et al.
2005/0170750 A1 8/2005 Andideh et al.
2005/0221741 A1 10/2005 Reinhardt et al.
2005/0260929 A1 11/2005 Shiho et al.
2005/0287932 A1 12/2005 Basol et al.
2006/0151110 A1 7/2006 Laursen et al.
2006/0194530 A1 8/2006 Thomson et al.
2006/0217049 A1 9/2006 Li et al.
2006/0286350 A1 12/2006 Hendron et al.
2007/0032182 A1 2/2007 Suzuki
2007/0034614 A1 2/2007 McClain et al.
2007/0066200 A9 3/2007 Li et al.
2007/0093191 A1 4/2007 Wang et al.
2007/0135024 A1 6/2007 Kobata et al.
2007/0197147 A1 8/2007 Rondum et al.
2007/0202780 A1 8/2007 Feng et al.
2007/0212979 A1 9/2007 Preston
2008/0003935 A1 1/2008 Feng et al.
2008/0003936 A1 1/2008 Swedek et al.
2008/0009228 A1 1/2008 Nagase et al.
2008/0045125 A1 2/2008 Choi
2008/0064302 A1 3/2008 Fujitani
2008/0064311 A1 3/2008 Suzuki
2008/0085661 A1 4/2008 Hsu et al.
2008/0090498 A1 4/2008 Misra et al.
2008/0090503 A1 4/2008 Park et al.
2008/0139094 A1 6/2008 Soeta
2008/0160890 A1 7/2008 He et al.
2008/0207100 A1 8/2008 Roy et al.
2008/0211141 A1 9/2008 Deopura et al.
2008/0220702 A1 9/2008 Feng et al.
2008/0293332 A1 11/2008 Watanabe et al.
2009/0047883 A1 2/2009 Jiang et al.
2009/0053976 A1 2/2009 Roy et al.
2009/0104849 A1 4/2009 Wang
2009/0120803 A9 5/2009 Butterfield et al.
2009/0191794 A1 7/2009 Wang
2009/0209185 A1 8/2009 Motonari et al.
2009/0258587 A1 10/2009 Feng et al.
2010/0009601 A1 1/2010 Wang
2010/0056031 A1 3/2010 Chiu et al.

* cited by examiner

GROOVED CMP PAD

CROSS-REFERENCE TO RELATED APPLICATIONS

This application claims benefit of U.S. Provisional Application No. 61/036,897, filed on Mar. 14, 2008, which is incorporated herein by reference in its entirety.

FIELD

In general, the designs and methods described herein are in the field of polishing pads for chemical mechanical planarization or chemical mechanical polishing ("CMP"). More particularly, the designs and methods described herein are related to novel groove configurations and in-situ grooves for CMP pads.

BACKGROUND

In general, CMP is used to planarize individual layers (e.g., dielectric or metal layers) during integrated circuit ("IC") fabrication on a semiconductor wafer. CMP removes undesirable topographical features of the IC on the wafer. For example, CMP removes metal deposits subsequent to damascene processes, and excess oxide from shallow trench isolation steps. Similarly, CMP may also be used to planarize inter-metal dielectrics ("IMD"), or devices with complex architecture, such as system-on-a-chip ("SoC") designs and vertical gate structures (e.g., FinFET) with varying pattern density.

CMP utilizes a reactive liquid medium, commonly referred to as a slurry, and a polishing pad to provide chemical and mechanical control to achieve planarity. Either the liquid or the polishing pad may contain nano-size inorganic particles to enhance chemical reactivity and/or mechanical activity of the CMP process. The pad is typically made of a rigid, microporous polyurethane or poly (urethane-urea) material capable of performing several functions including slurry transport, distribution of applied pressure across a wafer, and removal of reacted products. During CMP, the chemical interaction of the slurry forms a chemically modified layer at the polishing surface. Simultaneously, the abrasives in the slurry mechanically interact with the chemically modified layer, resulting in material removal. The material removal rate in a CMP process is related to slurry abrasive concentration and the average coefficient of friction (f) in the pad/slurry/wafer interfacial region. The extent of normal forces, shear forces, and the average coefficient of friction during CMP typically depends on pad tribology. Recent studies indicate that pad material compliance, pad contact area, and the extent of lubricity of the system play roles during CMP processes. See, for example, A. Philiposian and S. Olsen, *Jpn. J. Appl. Phys.*, vol. 42, pp 6371-63791; *Chemical-Mechanical Planarization of Semiconductors*, M. R. Oliver (Ed.), Springer Series in Material Science, vol. 69, 2004; and S. Olsen, M. S. Thesis, University of Arizona, Tucson, Ariz., 2002.

An effective CMP process not only provides a high polishing rate, but also a finished (e.g., lacking small-scale roughness) and flat (e.g., lacking in large-scale topography) substrate surface. The polishing rate, finish, and flatness are thought to be governed by the pad and slurry combination, pad/wafer relative velocity, and the applied normal force pressing the substrate against the pad.

Two commonly occurring CMP non-uniformities are edge effects and center slow effects. Edge effects occur when the substrate edge and substrate center are polished at different rates. Center slow effects occur when there is under-polishing at the center of the substrate. These non-uniform polishing effects reduce overall flatness.

Another commonly observed problem relates to slurry transport and distribution. In the past, polishing pads had perforations. These perforations, when filled, distributed slurry when the pad was compressed. See, for example, J. Levert et al., *Proc. Of the International Tribology Conf*, Yokohoma, 1995. This method was ineffective because there was no way to directly channel the excess slurry to where it was most needed (i.e., at the wafer surface). Currently, macro-texturing of pads is typically done through ex-situ pad surface groove design. See, for example, U.S. Pat. Nos. 5,842,910; 5,921,855; 5,690,540; and T. K. Doy et al., *J. of Electrochem. Soc.*, vol. 151, no. 3, G196-G199, 2004. Such designs include circular grooves (e.g., concentric grooves referred to as "K-grooves") and cross-hatched patterns (e.g., X-Y, hexagons, triangles, etc.). The groove profile may also be rectangular with "V-," "U-," or saw-tooth shaped cross sections.

SUMMARY

Novel groove configurations for CMP pads and methods for producing in-situ grooves in CMP pads are described.

Generally, CMP pads are described as having groove configurations comprising primary grooves and secondary grooves, wherein said primary grooves are radial in nature and said secondary grooves transect sectors as defined, in part, by the primary grooves. In addition to these primary features, the CMP pads further comprise an optional terminal groove, which, in some instances, is coincident with the outermost secondary groove, and a groove pattern center that is optionally coincident with the CMP pad center. The CMP pads described herein may be circular CMP pads or they may be constructed as CMP belts. Groove configurations described for circular CMP pads can be easily translated to CMP belts as described in further detail below. The CMP pads may be made from polyurethane or poly (urethane-urea), and the grooves produced therein may be made by a method from the group consisting of molding (e.g., compression, vacuum molding, etc.), laser writing, water jet cutting, 3-D printing, thermoforming, vacuum forming, micro-contact printing, hot stamping, and mixtures thereof.

In general, the methods for producing in-situ grooves comprise the steps of patterning a mold, adding CMP pad material to the mold, and allowing the CMP pad to solidify. In some variations, the mold is made from a silicone elastomer or a metal such as aluminum.

In some variations, the mold is metallic. For example, the mold may be made from a material selected from the group consisting of aluminum, steel, ultramold material, and mixtures thereof. In some variations, the mold is patterned, in addition to the patterning of the silicone lining (i.e., a combination of patterning is used). In some variations, the CMP pad material comprises a thermoplastic material. In other variations, the CMP pad material comprises a thermoset material. In some variations, the CMP pad material is polyurethane or poly (urethane-urea).

DETAILED DESCRIPTION

Figure 1:
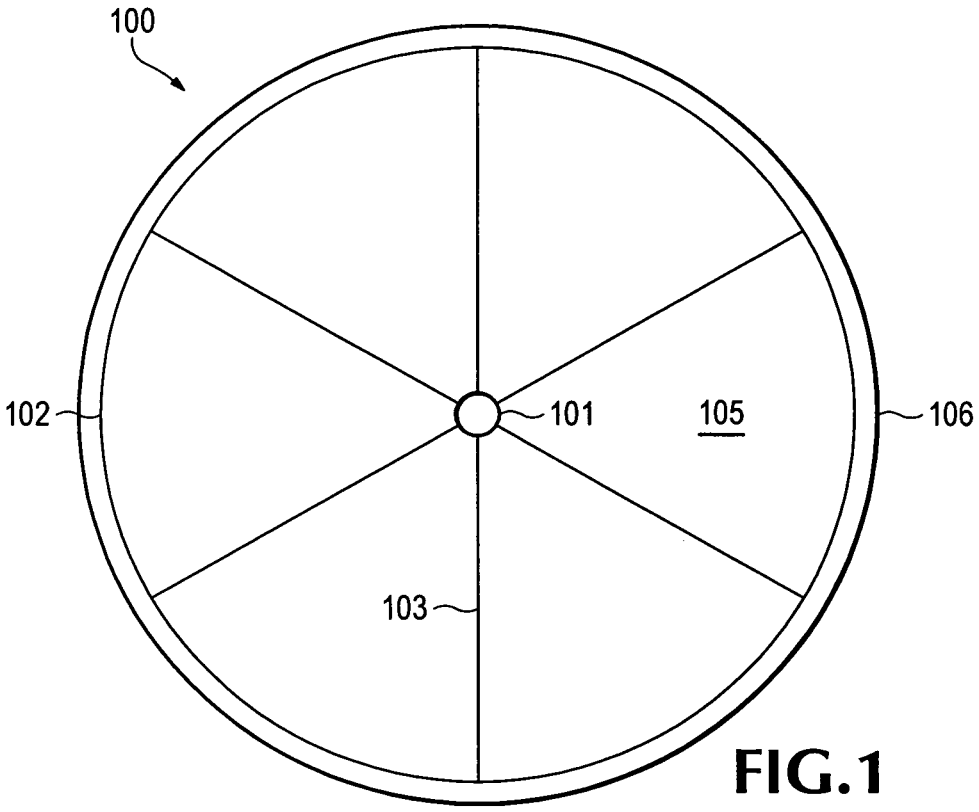
FIGS. 1-7 provide illustrations of exemplary primary groove designs as described herein.

Described herein are pads having novel groove designs and methods for in-situ CMP grooving. Grooves in CMP pads are thought to prevent hydroplaning of the wafer being polished across the surface of the pad; to help provide distribution of the slurry across the pad surface; to help ensure that sufficient slurry reaches the interior of the wafer; to help control localized stiffness and compliance of the pad in order to control polishing uniformity and minimize edge effects; and to provide channels for the removal of polishing debris from the pad surface in order to reduce defectivity.

Novel Groove Configurations

The CMP pads described herein have novel groove configurations comprising primary ("primary") grooves and secondary ("secondary") grooves. In addition to these features, the CMP pads further comprise an optional terminal groove, which, in some embodiments, is coincident with the outermost secondary groove. In other embodiments, the terminal groove is not a secondary groove. For instance, the terminal groove may be circular groove encompassing the entire groove pattern and sharing the same center as the CMP pad. The CMP pads, as described in further detail below, may also have a groove pattern center that is coincident with the CMP pad center. In some embodiments, the groove pattern center is off-center in relation to the CMP pad center. The pads described herein are described in the context of circular pads; however, the invention is not limited to circular pads. As it is known in the art, CMP pads can also be constructed as belts. As such, the center of a circular CMP pad (a point) is also a reference to the center of a CMP belt (a lengthwise line). The outer edge of a circular CMP pad is also a reference to the edge (or edges) of a CMP belt. If a primary groove is described as radiating from the center of a circular CMP pad to the outer edge of said circular pad, then that primary groove also extends from the center of a CMP belt to the edge of said CMP belt. If a secondary groove is described as transecting a sector of a circular CMP pad defined by adjacent primary grooves and the outer edge of said circular pad, then that secondary groove also transects sections of a CMP belt defined by adjacent primary grooves, the center of said belt, and the edge of said belt.

The primary grooves are typically radial and may extend from, for example, the center of the CMP pad or some point near the center of said pad. In some embodiments, the intersection of the primary grooves ("groove pattern center") coincides with the center of the CMP pad. In some embodiments, the intersection of the primary grooves does not coincide with the center of the CMP pad; i.e., the groove pattern center is off-center. Still, in other embodiments, whether on-center or off-center, the primary grooves do not intersect at all. In these embodiments, the projected intersection of the primary grooves is void of grooves or comprises an alternate groove configuration. The primary grooves terminate at, for example, the outer edge of the CMP pad or just before the outer edge of said pad. In some embodiments, the above-mentioned terminal groove is absent and the primary grooves terminate at the edge of the CMP pad. If the primary grooves terminate before the outer edge of the CMP pad, said primary grooves terminate in a terminal groove, which is, optionally the outermost secondary groove (or grooves). When the terminal groove is not the outermost secondary groove (or grooves), said terminal groove may be, for example, a circular groove having the same center as the groove pattern center, which may or may not be coincident with the center of the CMP pad. In some embodiments, the center of the terminal groove is the axis of rotation of the CMP pad and the primary grooves terminate off-center.

The secondary grooves typically transect sectors bounded, in part, by primary grooves. As follows, different groove configurations further describe said sectors. In general, a CMP pad "sector" is analogous to the pie- or wedge-shaped section of a circle enclosed by two radii and an arc; however, the exact shape of a CMP pad sector depends on elements such as the primary grooves, the groove pattern center (i.e., the point or projected point at which the primary grooves intersect), the terminal groove, and/or CMP pad edge. In a non-limiting example, the intersection of linear primary grooves and segments of the CMP pad circumference create pie-shaped CMP pad sectors. In another non-limiting example, CMP pad sectors are created from segments of the CMP pad circumference and the intersection of primary grooves that are linear toward the CMP pad center and logarithmic toward the CMP pad edge. In yet another non-limiting example, the intersection of sinusoidal primary grooves and segments of the terminal groove create CMP pad sectors.

Primary, secondary, and terminal grooves may be straight, curved, or in any combinations thereof. Curved grooves include, but are not limited to, logarithmic, sinusoidal, and non-sinusoidal grooves. Sinusoidal grooves may be based on simple waveforms or more complex waveforms (e.g., damped waves, waves resulting from superposition, etc.). Likewise, non-sinusoidal grooves may be based on simple waveforms of more complex waveforms. Examples of non-sinusoidal waveforms include, but are not limited to, square waves, triangle waves, sawtooth waves. Non-sinusoidal grooves are not necessarily based on periodic waveorms; however, grooves that are based on periodic waveforms (sinusoidal or non-sinusoidal) may have any period or fraction or multiple thereof. Combination grooves may include, for instance, primary grooves that are linear at an inner portion of the CMP pad and sinusoidal or logarithmic at an outer portion of the CMP pad.

Primary, secondary, and terminal grooves may be from about 4 to about 100 mils deep at any given point on said grooves. In some embodiments, the grooves are about 10 to about 50 mils deep at any given point on said grooves. The grooves may be of uniform depth, variable depth, or any combinations thereof. In some embodiments, the grooves are all of uniform depth. For example, the primary grooves and secondary grooves may all have the same depth. In some embodiments, the primary grooves may have a certain uniform depth and the secondary grooves may have a different uniform depth. For example, the primary grooves may be uniformly deeper than the secondary grooves. In another example, the primary grooves may be uniformly shallower than the secondary grooves. In some embodiments, groove depth increases with increasing distance from the center of the CMP pad. In some embodiments, groove depth decreases with increasing distance from the center of the CMP pad. In some embodiments, the depth of the primary grooves varies with increasing distance from the center of the CMP pad while the depth of the secondary grooves remains uniform. In some embodiments, the depth of the secondary grooves varies with increasing distance from the center of the CMP pad while the depth of the primary grooves remains uniform. In some embodiments, grooves of uniform depth alternate with grooves of variable depth. In a non-limiting example, primary grooves of uniform depth may alternate with primary grooves of variable depth, while secondary grooves are of uniform depth.

Primary, secondary, and terminal grooves may be from about 2 to about 100 mils wide at any given point on said grooves. In some embodiments, the grooves are about 15 to about 50 mils wide at any given point on said grooves. The grooves may be of uniform width, variable width, or any combinations thereof. In some embodiments, the grooves are all of uniform width. For example, the primary grooves and secondary grooves may all have the same width. In some embodiments, the primary grooves may have a certain uniform width and the secondary grooves may have a different uniform width. For example, the primary grooves may be uniformly wider than the secondary grooves. In another example, the primary grooves may be uniformly narrower than the secondary grooves. In some embodiments, groove width increases with increasing distance from the center of the CMP pad. In some embodiments, groove width decreases with increasing distance from the center of the CMP pad. In some embodiments, the width of the primary grooves varies with increasing distance from the center of the CMP pad while the width of the secondary grooves remains uniform. In some embodiments, the width of the secondary grooves varies with increasing distance from the center of the CMP pad while the width of the primary grooves remains uniform. In some embodiments, grooves of uniform width alternate with grooves of variable width. In a non-limiting example, primary grooves of uniform width may alternate with primary grooves of variable width, while secondary grooves are of uniform width.

In accordance with the previously described depth and width dimensions, primary, secondary, and terminal grooves may be of uniform volume, variable volume, or any combinations thereof. In some embodiments, the grooves are all of uniform volume. For example, the primary grooves and secondary grooves may all have the same volume. In some embodiments, the primary grooves may have a certain uniform volume and the secondary grooves may have a different uniform volume. For example, the primary grooves may be uniformly more voluminous than the secondary grooves. In another example, the primary grooves may be uniformly less voluminous than the secondary grooves. In some embodiments, groove volume increases with increasing distance from the center of the CMP pad. In some embodiments, groove volume decreases with increasing distance from the center of the CMP pad. In some embodiments, the volume of the primary grooves varies with increasing distance from the center of the CMP pad while the volume of the secondary grooves remains uniform. In some embodiments, the volume of the secondary grooves varies with increasing distance from the center of the CMP pad while the volume of the primary grooves remains uniform. In some embodiments, grooves of uniform volume alternate with grooves of variable volume. In a non-limiting example, primary grooves of uniform volume may alternate with primary grooves of variable volume, while secondary grooves are of uniform volume.

Secondary grooves may have a pitch from about 30 to about 1000 mils. In some embodiments, the grooves have a pitch of about 125 mils. For a circular CMP pad, secondary groove pitch is measured along the radius of a circular CMP pad. In CMP belts, secondary groove pitch is measured from the center of the CMP belt to an edge of the CMP belt. The grooves may be of uniform pitch, variable pitch, or in any combinations thereof. In some embodiments, the grooves are all of uniform pitch. In some embodiments, groove pitch increases with increasing distance from the center of the CMP pad. In some embodiments, groove pitch decreases with increasing distance from the center of the CMP pad. In some embodiments, the pitch of the secondary grooves in one sector varies with increasing distance from the center of the CMP pad while the pitch of the secondary grooves in an adjacent sector remains uniform. In some embodiments, the pitch of the secondary grooves in one sector increases with increasing distance from the center of the CMP pad while the pitch of the secondary grooves in an adjacent sector increases at a different rate. In some embodiments, the pitch of the secondary grooves in one sector increases with increasing distance from the center of the CMP pad while the pitch of the secondary grooves in an adjacent sector decreases with increasing distance from the center of the CMP pad. In some embodiments, grooves of uniform pitch alternate with grooves of variable pitch. In a non-limiting example, the primary grooves may be linear near the CMP pad center and logarithmic toward the CMP pad edge. As such, the pitch of the secondary grooves may be uniform over the linear portion of the primary grooves and variable (e.g., decreasing) over the logarithmic portion of the primary grooves. In some embodiments, sectors of secondary grooves of uniform pitch may alternate with sectors of secondary grooves of variable pitch.

Grooves, of any sort (e.g., primary grooves, secondary grooves, terminal grooves, etc.), may be flared. From an alternative viewpoint, flared grooves may, in some instances, be interpreted as beveled or chamfered plateau regions. Grooves may be flared at any angle necessary to affect desired slurry flow, turbulence, removal rate, selectivity, and the like. Grooves may be flared along their length or just a portion thereof. In a non-limiting example, plateau region termini may be beveled or chamfered (as described below) while the remainder of the plateau region is not beveled or chamfered. In some embodiments, all grooves are flared. In a non-limiting example, both primary grooves and secondary grooves are flared, but the primary grooves are flared to a greater degree than that of the secondary grooves. In some embodiments, some grooves may be flared while adjacent grooves are not. In a non-limiting example, every other secondary groove is flared. In some instances, only primary grooves are flared. In some instances, only secondary grooves are flared.

Junctions are formed at the intersection of primary and secondary grooves. A 4-way junction occurs when two secondary grooves from adjacent sectors meet on a primary groove. If 4-way junctions occur along the length of primary groove, adjacent sectors are said to be "on-set" or "matched." Analogously, a 3-way junction occurs when two secondary grooves from adjacent sectors do not meet on a primary groove. If 3-way junctions occur along the length of a primary groove, adjacent sectors are said to be "off-set" or "mismatched." In some embodiments, some secondary grooves in a particular sector are matched with secondary grooves from an adjacent sector while other secondary grooves are mismatched. Still, in other embodiments, adjacent sectors are paired such that they match each other but are off-set when compared to an adjacent pair of sectors. The plateau regions between grooves may have unique features at junctions. In some embodiments, the plateau region termini at a junction are curved or rounded. In some embodiments, the plateau region termini at a junction are beveled or chamfered. In some embodiments, plateau region termini feature a combination of, for example, rounding and beveling. A plateau region terminus may be tailored independently of the other plateau region termini in a junction to facilitate slurry flow and transport of debris across the pad. In addition, a plateau region terminus may be adjusted to fit with the needs of the process (e.g., defects, polish rates, selectivity, and uniformity requirements, etc.).

Some areas of the CMP pad may need more slurry to be available for altering removal rates. Dam intermediates or dams may be placed in primary grooves, secondary grooves, in a terminal groove, or in any other pad location or combination of pad locations in which enhanced slurry collection is desired. Dams with random or calculated breaks may also be used to affect slurry collection in specific pad locations. In some embodiments, dams are used in every other primary groove. In some embodiments, dams are used in every other secondary groove within a sector.

The CMP pads described herein may further comprise a window for CMP systems that use optical endpoint determination. The location of the endpoint determination region or window may lie along a primary groove. Window placement along a primary groove allows for continuous slurry flow and slurry refreshment in the endpoint determination region or window. This minimizes slurry buildup and thus minimizes defect generation due to the presence of the window. The nature (e.g., depth, width, pitch, and/or other dimensions) of the grooves proximate to the window may be similar or different than the rest of the grooves in the region depending on the manner in which the window affects slurry flow. Grooves proximate to the window, for example, may be wider or shallower if those dimensions or a combination thereof facilitates slurry into and out of the endpoint determination region.

The CMP pads, in addition to any of the novel groove configurations described herein, may further comprise features such as macro-pores, macro-voids, reservoirs, dimples, studs, or islands, or combinations thereof. Typically, these features are limited to the polishing pad surface.

In addition to the novel groove configurations described above, CMP pads may also feature random grooves and/or irregular shaped features on the pad surface. These random grooves and/or irregular shaped features may be present with or without primary grooves.

Description of the CMP groove configurations described herein is intended to encompass mirror images (or reflections) of those groove configurations. As such, the CMP pad variation described in FIG. 8 (below), for example, also encompasses the mirror image of the CMP pad variation described in FIG. 8. In another non-limiting example, reference to primary grooves that are linear toward the CMP pad center and logarithmic toward the CMP pad edge is also a reference to primary grooves that are linear toward the CMP pad center and reverse logarithmic toward the CMP pad edge.

Figure 8:
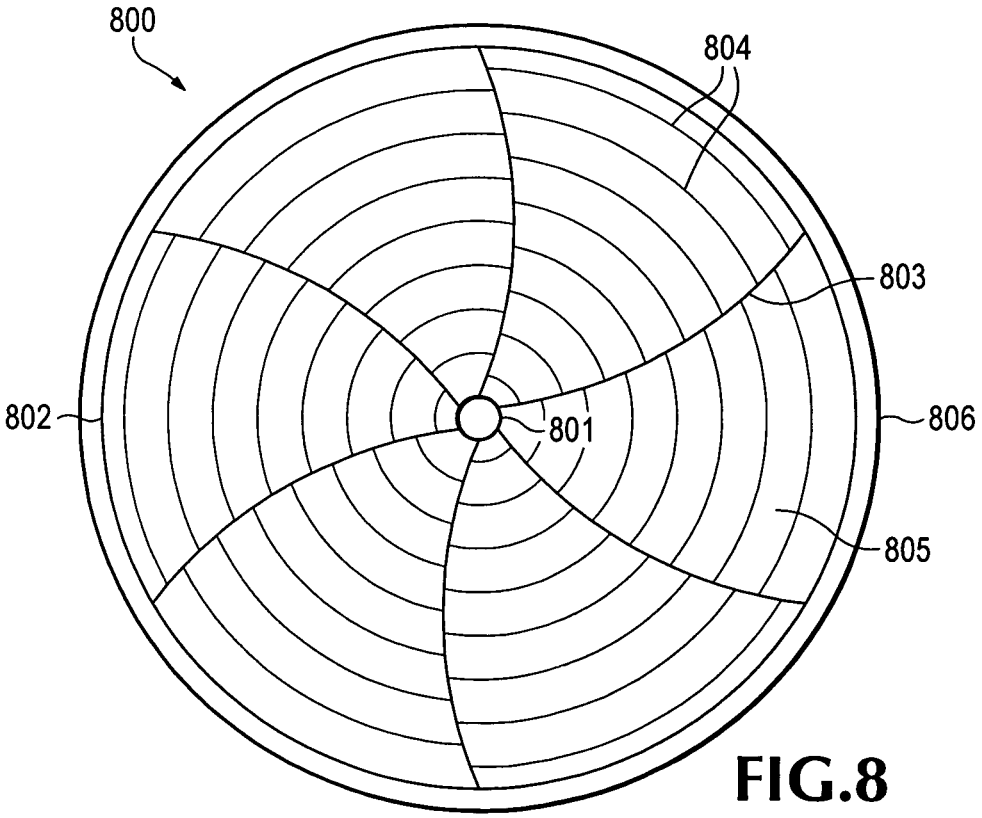
FIGS. 8-16 provide illustrations of exemplary primary and secondary combination groove designs as described herein.
Figure 9:
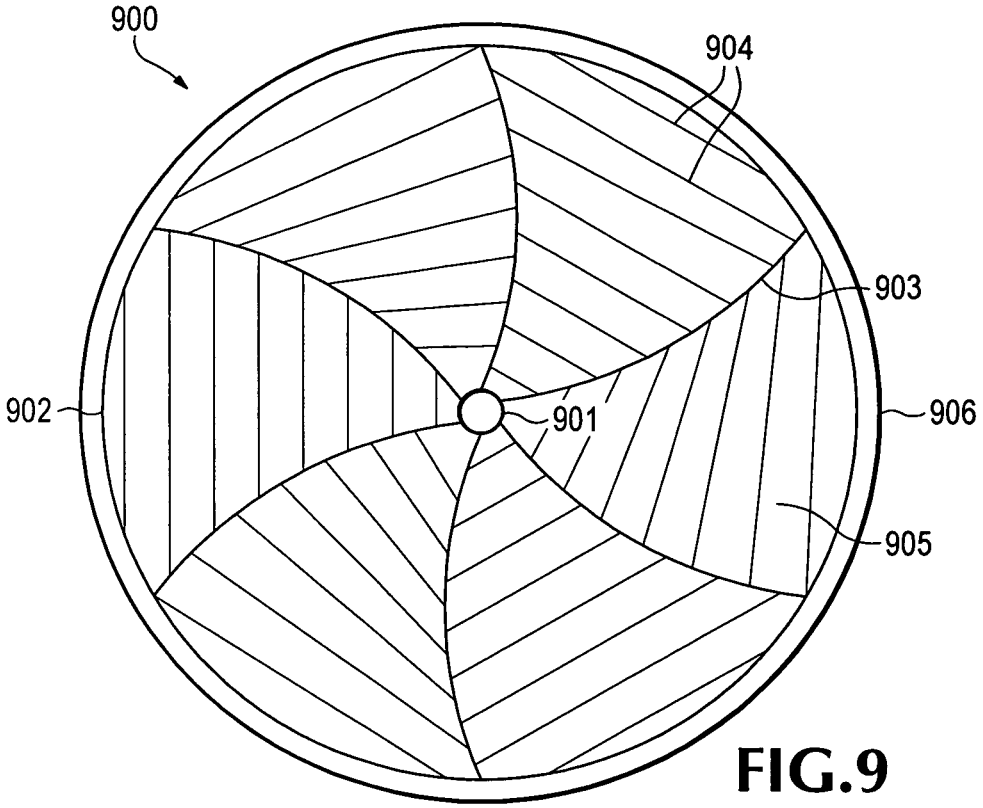

FIGS. 1-16 are provided with accompanying description to further illustrate CMP pads comprising novel groove configurations and in no way limits the invention. FIG. 1, for instance, shows six linear primary grooves; however, this is not to be construed as limiting a CMP pad with linear primary grooves to six linear primary grooves. The CMP pad of FIG. 1 may have fewer than six, exactly six, or more than six linear primary grooves. In general, the CMP pads described herein may have as many primary grooves as needed to provide sufficient slurry in the wafer engaging area. Again, in reference to FIG. 1 (and by example only), the CMP pad does not show secondary grooves; however, this is not to be construed as limiting the CMP pad of FIG. 1 to primary grooves. The CMP pad of FIG. 1, for instance, may have any number of secondary grooves and of any style described herein. For example, the CMP pad of FIG. 1 may have secondary grooves as shown in either of FIG. 8, FIG. 9, or FIG. 10. In addition, certain drawings (e.g., FIG. 9, FIG. 11) and accompanying descriptions may focus on certain aspects of a CMP pad. FIG. 9, for instance, is a close-up view of a section of a CMP pad having linear secondary grooves. It is to be understood that the drawing focuses attention to certain features (e.g., groove design center (901), primary grooves (903), secondary grooves (904), sector (905)) and does not restrict the CMP pad illustrated in FIG. 9 to those features shown in FIG. 9. Though it is not explicitly shown, the CMP pad illustrated in FIG. 9, for example, may also have, for instance, a terminal groove.

In one variation, the CMP pad comprises features as illustrated in FIG. 1. In this variation, the CMP pad (100) comprises a groove design center (101), a pad edge (106), a terminal groove (102), primary grooves (103), and sectors (105). The groove pattern center (101) may be grooveless as shown or have an alternate groove pattern (e.g., a groove pattern selected from any one of the drawings or a mirror image thereof). Furthermore, the groove pattern center (101) may be coincident with the center of the CMP pad (100) or it may be offset. As shown in FIG. 1, the pad edge (106) may be grooveless and the primary grooves (103) may be linear. In this instance, sectors (105) are defined by the boundaries created by the groove design center (101), the terminal groove (102), and the linear primary grooves (103). The groove pattern center (101) is shown in FIG. 1 as being circular in shape. Alternatively, the boundary lines for this groove pattern center and the other centers as shown in FIGS. 2 to 15 may be straight lines between the primary groove lines as Shown in FIG. 16.

Figure 2:
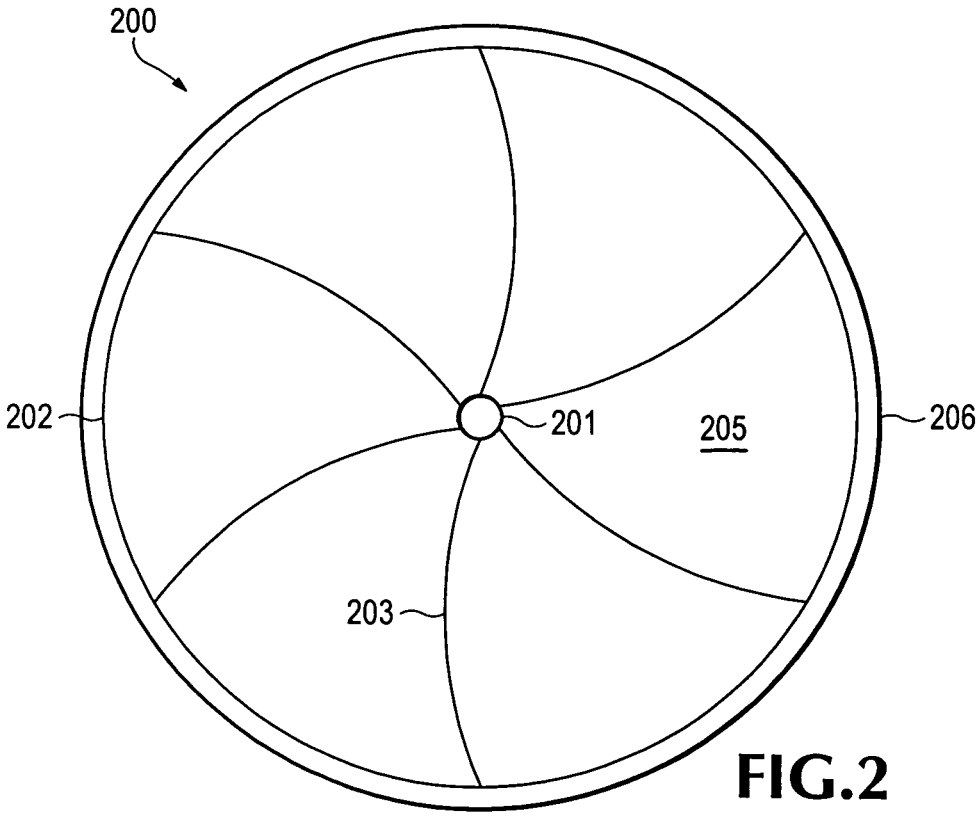

In a second variation, the CMP pad comprises features as illustrated in FIG. 2. In this variation, the CMP pad (200) comprises a groove design center (201), a pad edge (206), a terminal groove (202), primary grooves (203), and sectors (205). The groove pattern center (201) may be grooveless as shown or have an alternate groove pattern as previously described. Furthermore, the groove pattern center (201) may be coincident with the center of the CMP pad (200) or it may be offset. As shown in FIG. 2, the pad edge (206) may be grooveless and the primary grooves (203) may be logarithmic or linear toward the CMP pad center and logarithmic toward the CMP pad edge. In this instance, sectors (205) are defined by the boundaries created by the groove design center (201), the terminal groove (202), and the primary grooves (203).

Figure 3:
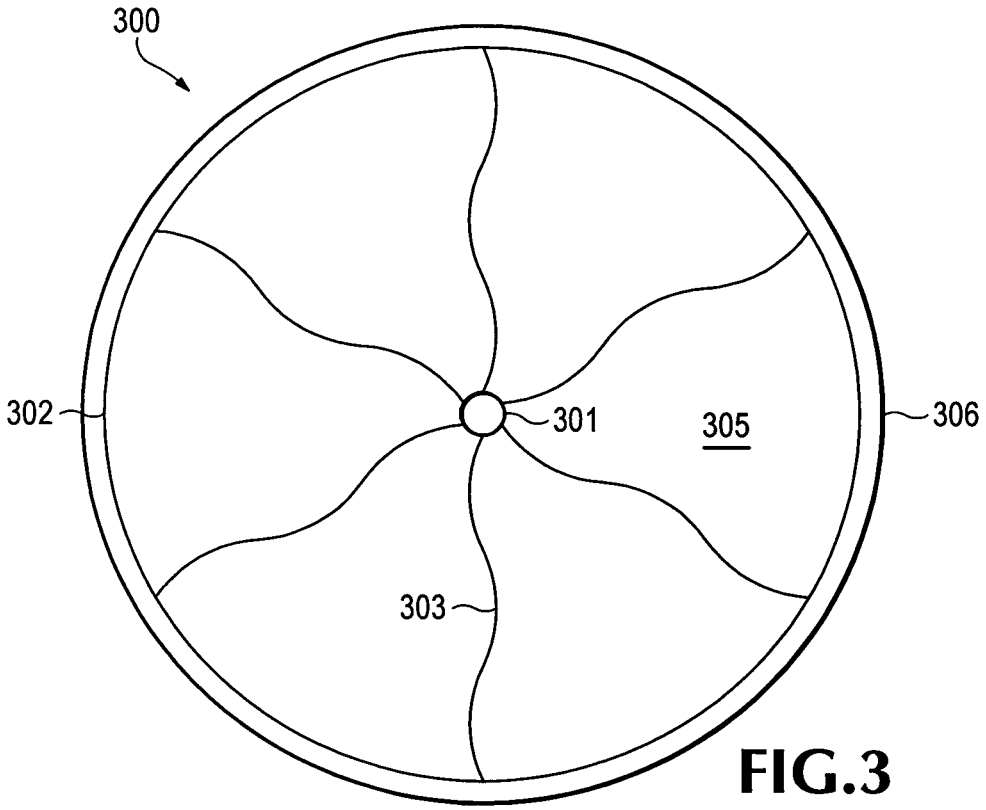

In a third variation, the CMP pad comprises features as illustrated in FIG. 3. In this variation, the CMP pad (300) comprises groove design center (301), a pad edge (306), a terminal groove (302), primary grooves (303), and sectors (305). The groove pattern center (301) may be grooveless as shown or have an alternate groove pattern as described above. Furthermore, the groove pattern center (301) may be coincident with the center of the CMP pad (300) or it may be offset. As shown in FIG. 3, the pad edge (306) may be grooveless and the primary grooves (303) may be sinusoidal. As previously described, the sinusoidal primary grooves (303) may have any period or fraction or multiple thereof. As such, the sinusoidal primary grooves (303) may have peaks nearest the groove pattern center (301) that is oriented in a clockwise direction (as shown). In this instance, sectors (305) are defined by the boundaries created by the groove design center (301), the terminal groove (302), and the sinusoidal primary grooves (303).

Figure 4:
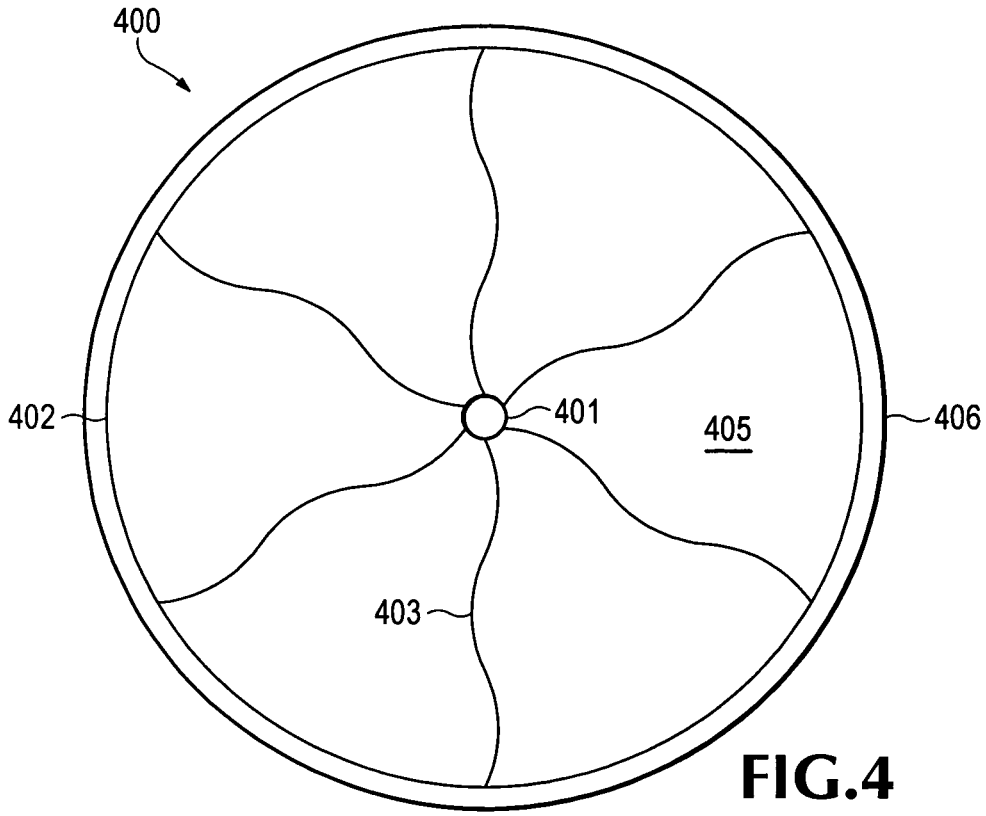

In a fourth variation, the CMP pad comprises features as illustrated in FIG. 4. In this variation, the CMP pad (400) comprises a groove design center (401), a pad edge (406), a terminal groove (402), primary grooves (403), and sectors (405). The groove pattern center (401) may be grooveless as shown or have an alternate groove pattern as described above. Furthermore, the groove pattern center (401) may be coincident with the center of the CMP pad (400) or it may be offset. As shown in FIG. 4, the pad edge (406) may be grooveless and the primary grooves (403) may be sinusoidal. As described above, the sinusoidal primary grooves (403) may have any period or fraction or multiple thereof. As such, the sinusoidal primary grooves (403) may have peaks nearest the groove pattern center (401) that is oriented in a counterclockwise direction (as shown). In this instance, sectors (405) are defined by the boundaries created by the groove design center (401), the terminal groove (402), and the sinusoidal primary grooves (403).

Figure 5:
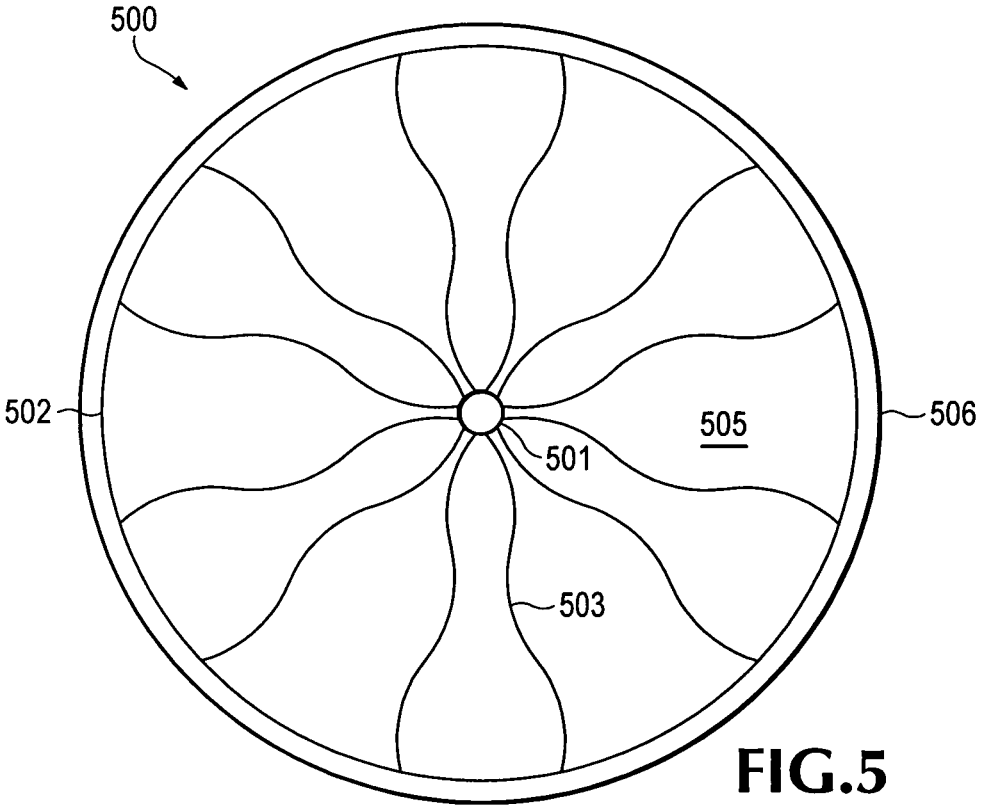

In a fifth variation, the CMP pad comprises features as illustrated in FIG. 5. In this variation, the CMP pad (500) comprises a groove design center (501), a pad edge (506), a terminal groove (502), primary grooves (503), and sectors (505). The groove pattern center (501) may be grooveless as shown or have an alternate groove pattern as described above. Furthermore, the groove pattern center (501) may be coincident with the center of the CMP pad (500) or it may be offset. As shown in FIG. 5, the pad edge (506) may be grooveless and the primary grooves (503) may be sinusoidal. As described above, the sinusoidal primary grooves (503) may have any period or fraction or multiple thereof. In this fifth variation, adjacent sinusoidal primary grooves (503) are paired as mirror images of each other. In this instance, sectors (505) are defined by the boundaries created by the groove design center (501), the terminal groove (502), and the primary grooves (503).

Figure 6:
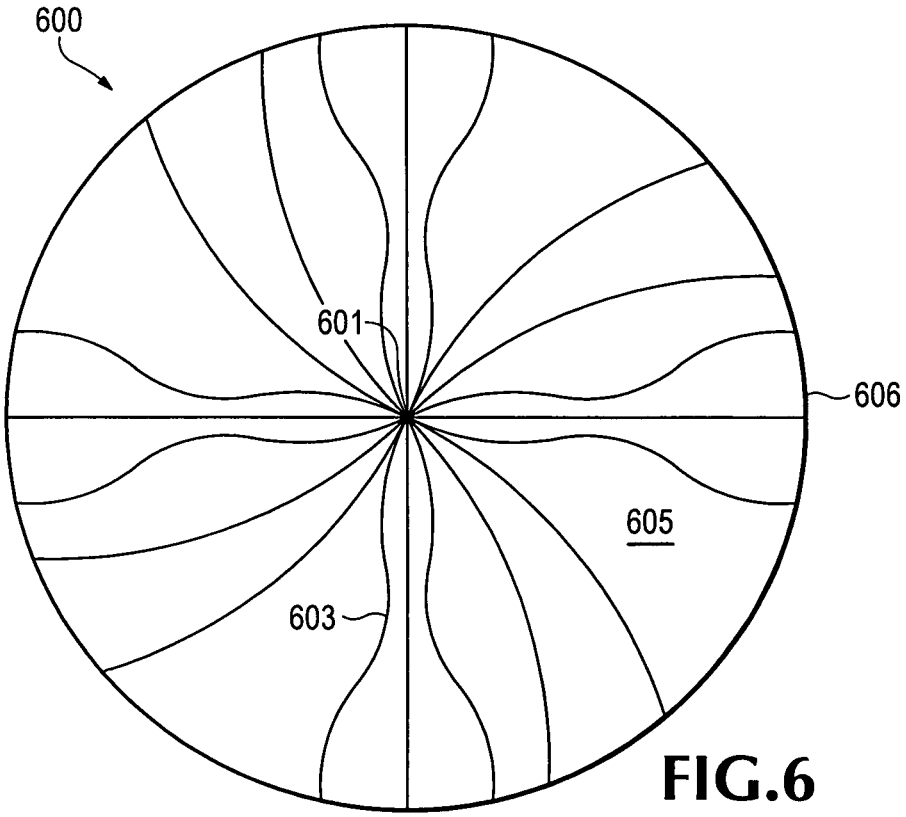

In a sixth variation, the CMP pad comprises features as illustrated in FIG. 6. In this variation, the CMP pad (600) comprises a groove design center (601), pad edge (606), primary grooves (603), and sectors (605). The groove pattern center (601) may be defined by the intersection of primary grooves (as shown); however, the groove pattern center (601) may be grooveless, as shown in other variations, or the groove pattern center (601) may have an alternate groove pattern. Furthermore, the groove pattern center (601) may be coincident with the center of the CMP pad (600) or it may be offset. As shown in FIG. 6, the primary grooves (603) may be a combination of different primary grooves such as linear, sinusoidal, and logarithmic (or linear toward the CMP pad center and logarithmic toward the CMP pad edge (606). As described above, the sinusoidal primary grooves (603) may have any period or fraction or multiple thereof. The sinusoidal primary grooves (603) may also be damped. In this sixth variation, sinusoidal primary grooves (603) may be paired as mirror images of each other with a linear primary groove in-between. In this instance, sectors (605) are defined by the boundaries created by the groove design center (601), the primary grooves (503), and the edge of CMP pad (600). In addition, this variation features a CMP pad (600) without a terminal groove. Instead of terminating in a terminal groove, the primary grooves (603), which are logarithmic or linear toward the CMP pad center and logarithmic toward the CMP pad edge (606), terminate at the edge of the CMP pad (606).

Figure 7:
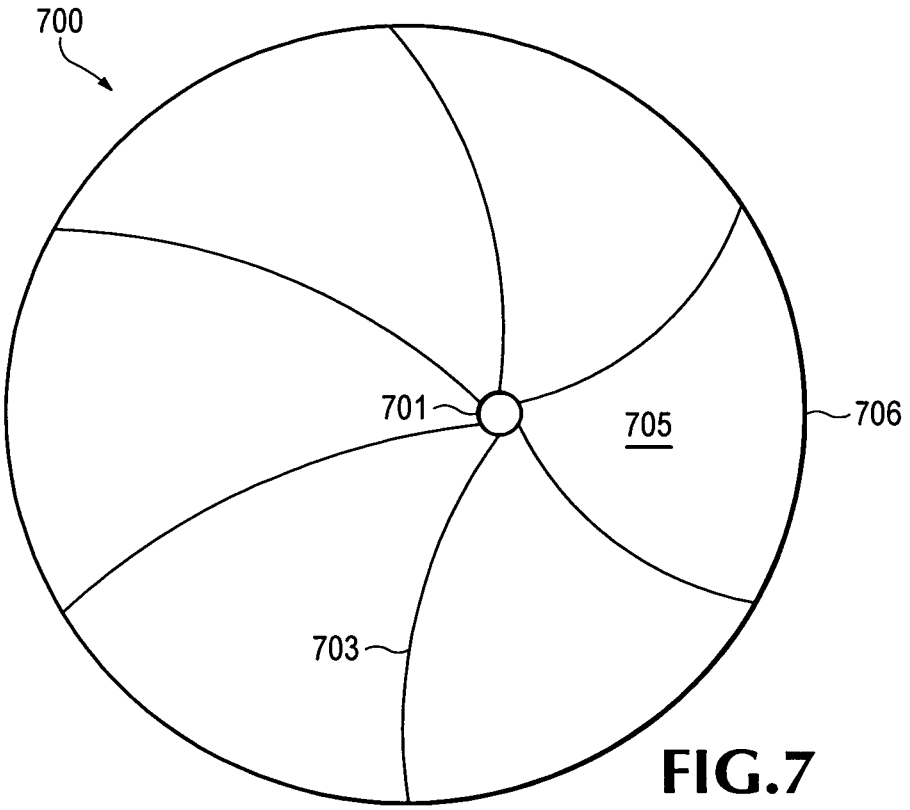

In a seventh variation, the CMP pad comprises features as illustrated in FIG. 7. In this variation, the CMP pad (700) comprises a groove design center (701), pad edge (706), primary grooves (703), and sectors (705). The groove pattern center (701) may be grooveless as shown or have an alternate groove pattern as described above. In this seventh variation, the groove pattern center (701) is not coincident with the center of the CMP pad (700); however, the groove pattern center (701) may be coincident with the center of the CMP pad (700) in some instances. In addition, this variation features a CMP pad (700) without a terminal groove. Instead of terminating in a terminal groove, the primary grooves (703), which are logarithmic or linear toward the CMP pad center and logarithmic toward the CMP pad edge (706), terminate at the edge of the CMP pad (706). As such, sectors (705) are defined by the primary grooves (703), the groove pattern center (701), and the edge of CMP pad (706).

Any of the CMP pads described above may lack secondary grooves. Alternatively, any of the CMP pads described above may have any of the secondary grooves discussed in paragraphs 18-23. For instance, in an eighth variation, the CMP pad comprises features as illustrated in FIG. 8. In this variation, the CMP pad (800) comprises a groove design center (801), a pad edge (806), a terminal groove (802), primary grooves (803), secondary grooves (804), and sectors (805). The groove pattern center (801) may be grooveless as shown or have an alternate groove pattern as described above. Furthermore, the groove pattern center (801) may be coincident with the center of the CMP pad (800) or it may be offset. As shown in FIG. 8, the pad edge (805) may be grooveless and the primary grooves (803) may be logarithmic or linear toward the CMP pad center and logarithmic toward the CMP pad edge. In this instance, sectors (805) are defined by the boundaries created by the groove design center (801), the terminal groove (802), and the primary grooves (803). The secondary grooves (804) of the CMP pad (800) are arcs that transect the sectors (805). As shown, the secondary grooves (804) are off-set (or mismatched) from sector to sector.

In a ninth variation, the CMP pad comprises features as illustrated in FIG. 9. In this variation, the CMP pad (900) comprises a groove design center (901), pad edge (906), primary grooves (903), secondary grooves (904), and sectors (905). The groove pattern center (901) may be grooveless as shown or have an alternate groove pattern as described above. Furthermore, the groove pattern center (901) may or may not be coincident with the center of the CMP pad (900) or it may be offset. As shown in FIG. 9, the primary grooves (903) may be logarithmic or linear toward the CMP pad center and logarithmic toward the CMP pad edge. The secondary grooves (904) may or may not be coincident with the terminal groove. As such, sector boundaries are partially defined by the groove design center (901) and the primary grooves (903). The linear secondary grooves (904) of the CMP pad (900) transect the sectors (905). Further inspection shows that the midpoint of each secondary groove falls on a virtual primary groove equidistant from the sector-bounding primary grooves. (A virtual primary groove is not an actual primary groove.) The secondary grooves (904) are also off-set (or mismatched) from sector to sector; however, secondary grooves (904) from adjacent sectors (905) may be matched in other embodiments.

Figure 10:
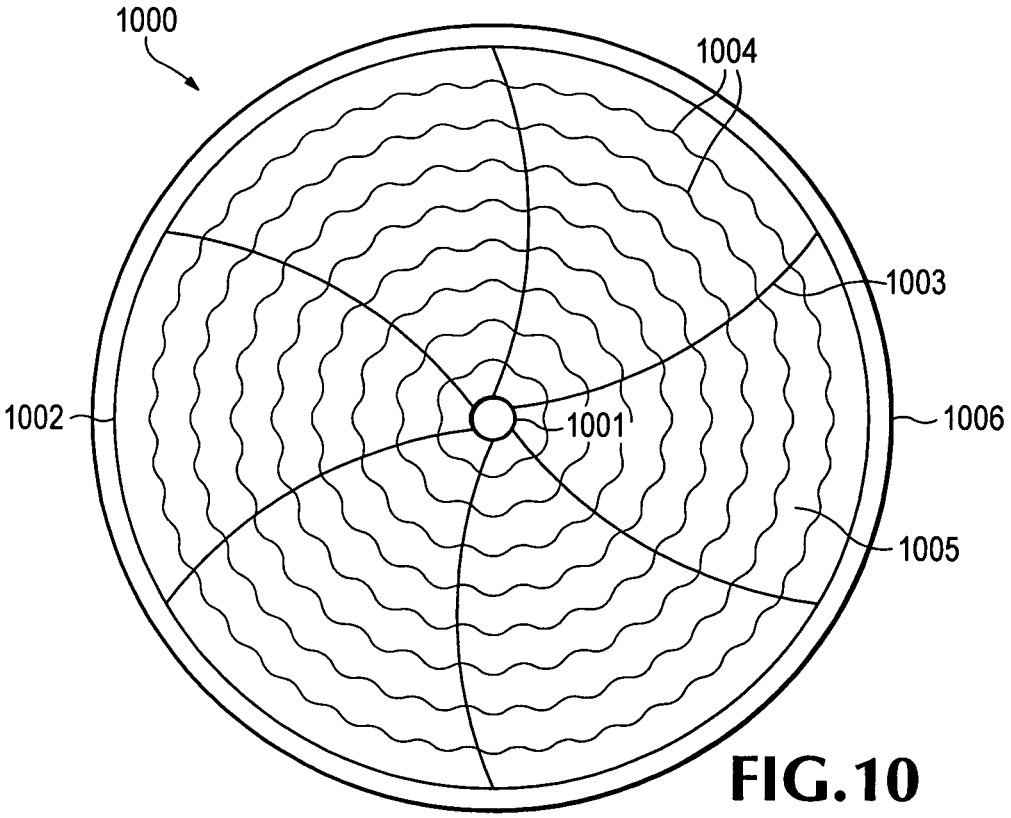

In a tenth variation, the CMP pad comprises features as illustrated in FIG. 10. In this variation, the CMP pad (1000) comprises a groove design center (1001), a pad edge (1006), a terminal groove (1002), primary grooves (1003), secondary grooves (1004), and sectors (1005). The groove pattern center (1001) may be grooveless as shown or have an alternate groove pattern as described above. Furthermore, the groove pattern center (1001) may be coincident with the center of the CMP pad (1000) or it may be offset. As shown in FIG. 10, the pad edge (1005) may be grooveless and the primary grooves (1003) may be logarithmic or linear toward the CMP pad center and logarithmic toward the CMP pad edge. In this instance, sectors (1005) are defined by the boundaries created by the groove design center (1001), the terminal groove (1002), and the primary grooves (1003). The sinusoidal secondary grooves (1004) (described in further detail above) of the CMP pad (1000) transect the sectors (1005). As shown, the secondary grooves (1004) are matched (or on-set) from sector to sector.

Figure 11:
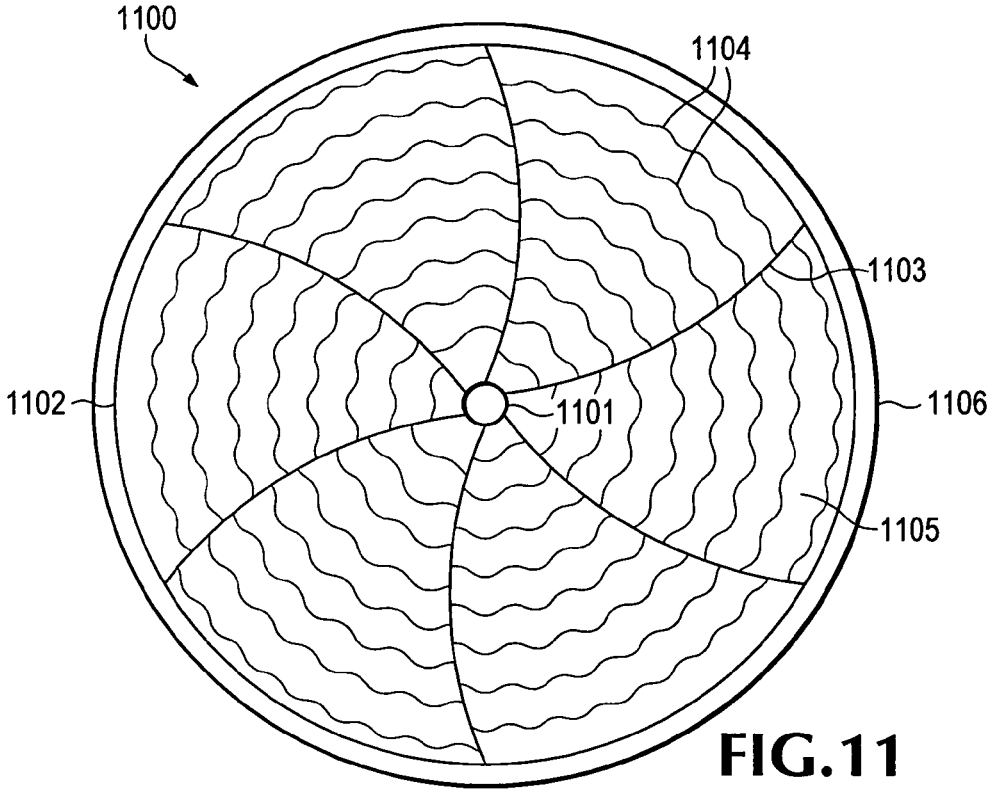

In an eleventh variation, the CMP pad comprises features as illustrated in FIG. 11. Like the CMP pad in FIG. 10, the CMP pad (1100) comprises a groove design center (1101), pad edge (1106), primary grooves (1103), secondary grooves (1104), and sectors (1105). The groove pattern center (1101) may be grooveless as shown or have an alternate groove pattern as described above. Furthermore, the groove pattern center (1101) may be coincident with the center of the CMP pad (1100) or it may be offset. As shown in FIG. 11, the primary grooves (1103) may be logarithmic or linear toward the CMP pad center (1101) and logarithmic toward the CMP pad edge (1106). In this instance, sectors (1105) are only partially defined by the groove design center (901) and the primary grooves (903). The sinusoidal secondary grooves (1104) (described in further detail above) of the CMP pad (1100) transect the sectors (1105) as partially defined. When compared to the CMP pad shown in FIG. 10, it is evident in this variation that the secondary grooves (1104) are mismatched (or off-set) from sector to sector.

Figure 12:
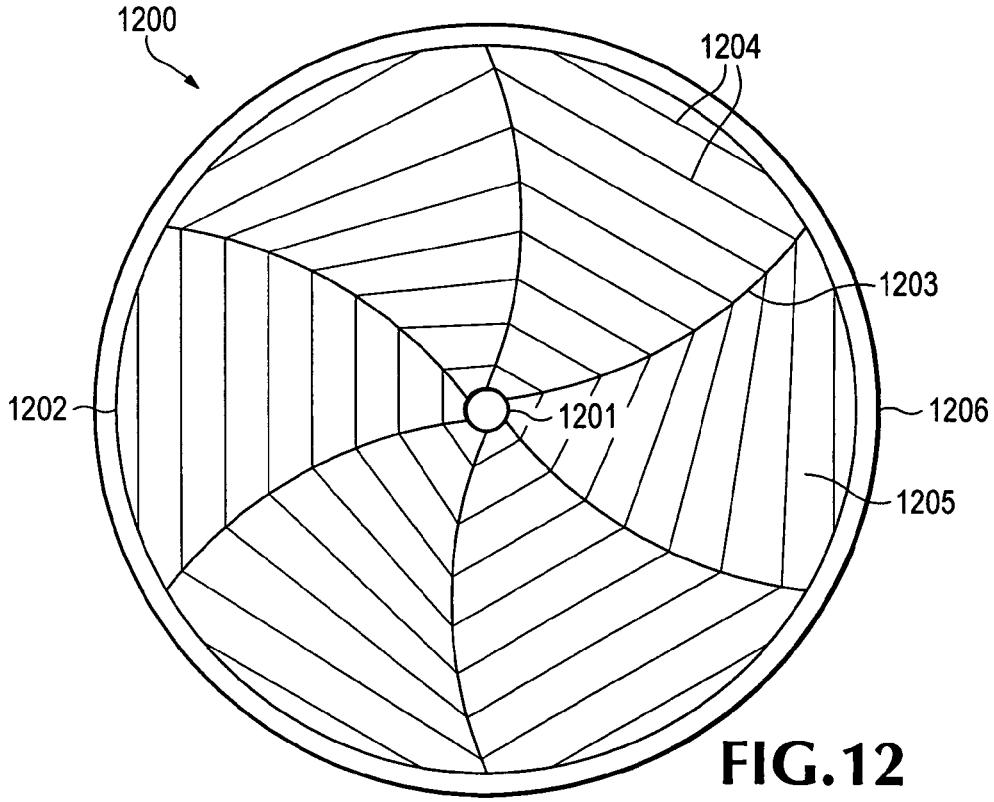

In a twelfth variation, the CMP pad comprises features as illustrated in FIG. 12. In this variation, the CMP pad (1200) comprises a groove design center (1201), a pad edge (1206), a terminal groove (1202), primary grooves (1203), secondary grooves (1204), and sectors (1205). The groove pattern center (1201) may be grooveless as shown or have an alternate groove pattern as described above. Furthermore, the groove pattern center (1201) may be coincident with the center of the CMP pad (1200) or it may be offset. As shown in FIG. 12, the pad edge (1205) may be grooveless and the primary grooves (1203) may be logarithmic or linear toward the CMP pad center and logarithmic toward the CMP pad edge. In this instance, sectors (1205) are defined by the boundaries created by the groove design center (1201), the terminal groove (1202), and the primary grooves (1203). The linear secondary grooves (1204) of the CMP pad (1200) transect the sectors (1205). As shown, the secondary grooves (1204) are matched (or on-set) from sector to sector and form "V-" shapes (with vertices pointing toward the pad edge) at the primary grooves (1203) in 4-way junctions.

Figure 13:
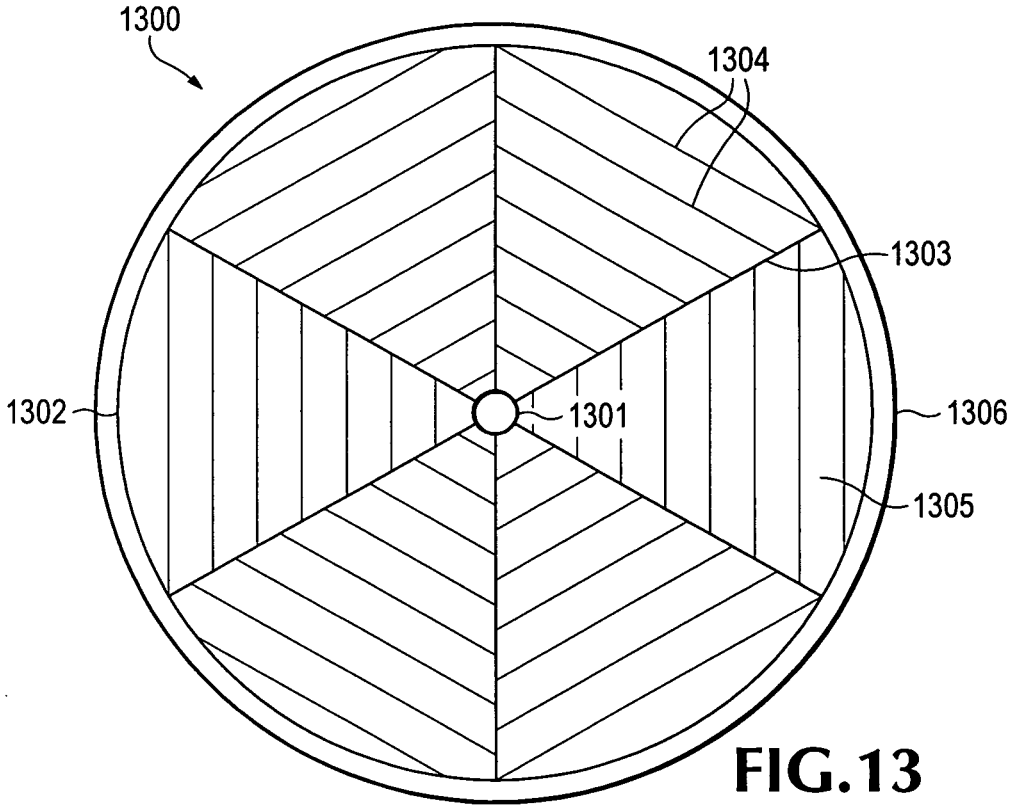

In a thirteenth variation, the CMP pad comprises features as illustrated in FIG. 13. In this variation, the CMP pad (1300) comprises a groove design center (1301), a pad edge (1306), a terminal groove (1302), primary grooves (1303), secondary grooves (1304), and sectors (1305). The groove pattern center (1301) may be grooveless as shown or have an alternate groove pattern as described above. Furthermore, the groove pattern center (1301) may be coincident with the center of the CMP pad (1300) or it may be offset. As shown in FIG. 13, the pad edge (1305) may be grooveless and the primary grooves (1303) may be logarithmic or linear toward the CMP pad center and logarithmic toward the CMP pad edge. In this instance, sectors (1305) are defined by the boundaries created by the groove design center (1301), the terminal groove (1302), and the primary grooves (1303). The linear secondary grooves (1304) of the CMP pad (1300) transect the sectors (1305). As shown, the secondary grooves (1304) are mismatched (or off-set) from sector to sector. If the secondary grooves (1304) of the CMP pad (1300) were matched (as in FIG. 12), they would form upside-down "V-" shapes (with vertices pointing toward the pad center) at the primary grooves (1303).

Figure 14:
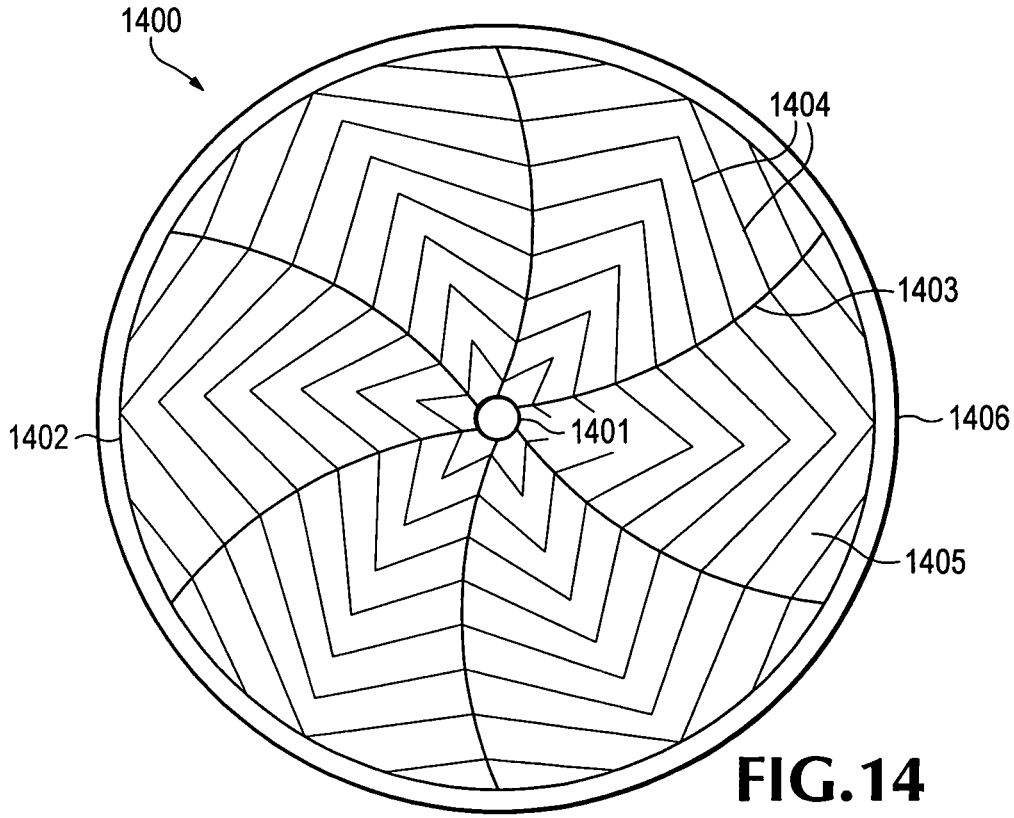

In a fourteenth variation, the CMP pad comprises features as illustrated in FIG. 14. In this variation, the CMP pad (1400) comprises a groove design center (1401), a pad edge (1406), a terminal groove (1402), primary grooves (1403), secondary grooves (1404), and sectors (1405). The groove pattern center (1401) may be grooveless as shown or have an alternate groove pattern as described above. Furthermore, the groove pattern center (1401) may be coincident with the center of the CMP pad (1400) or it may be offset. As shown in FIG. 14, the pad edge (1405) may be grooveless and the primary grooves (1403) may be logarithmic or linear toward the CMP pad center and logarithmic toward the CMP pad edge. In this instance, sectors (1405) are defined by the boundaries created by the groove design center (1401), the terminal groove (1402), and the primary grooves (1403). The "V-" shaped secondary grooves (1404) of the CMP pad (1400) transect the sectors (1405). As shown, vertices of the "V-" shaped secondary grooves (1404) point toward the edge of the CMP pad (1400) and fall along a virtual primary groove equidistant from the sector-bounding primary grooves. The secondary grooves (1404), as shown, are matched (or on-set) from sector to sector; however, mismatched secondary grooves (1504) are also possible. The "V-" shaped secondary grooves (1404) of FIG. 14 provide a non-limiting example of a secondary groove based on a non-sinusoidal waveform (e.g., triangle wave).

Figure 15:
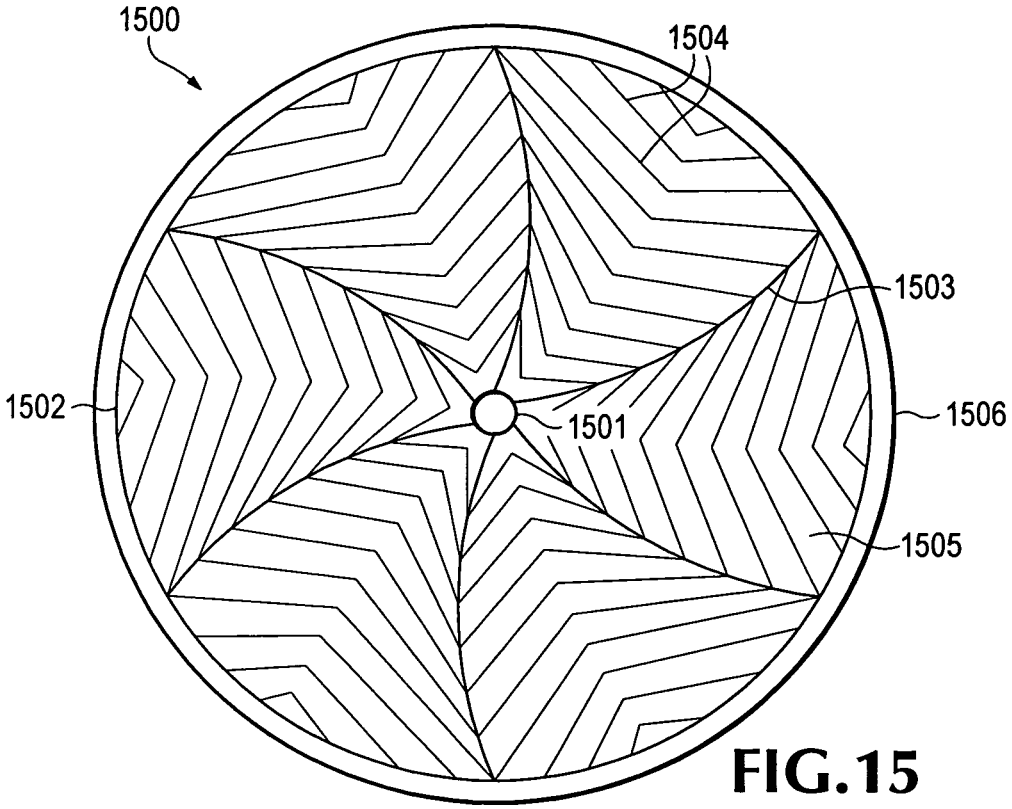
Figure 16:
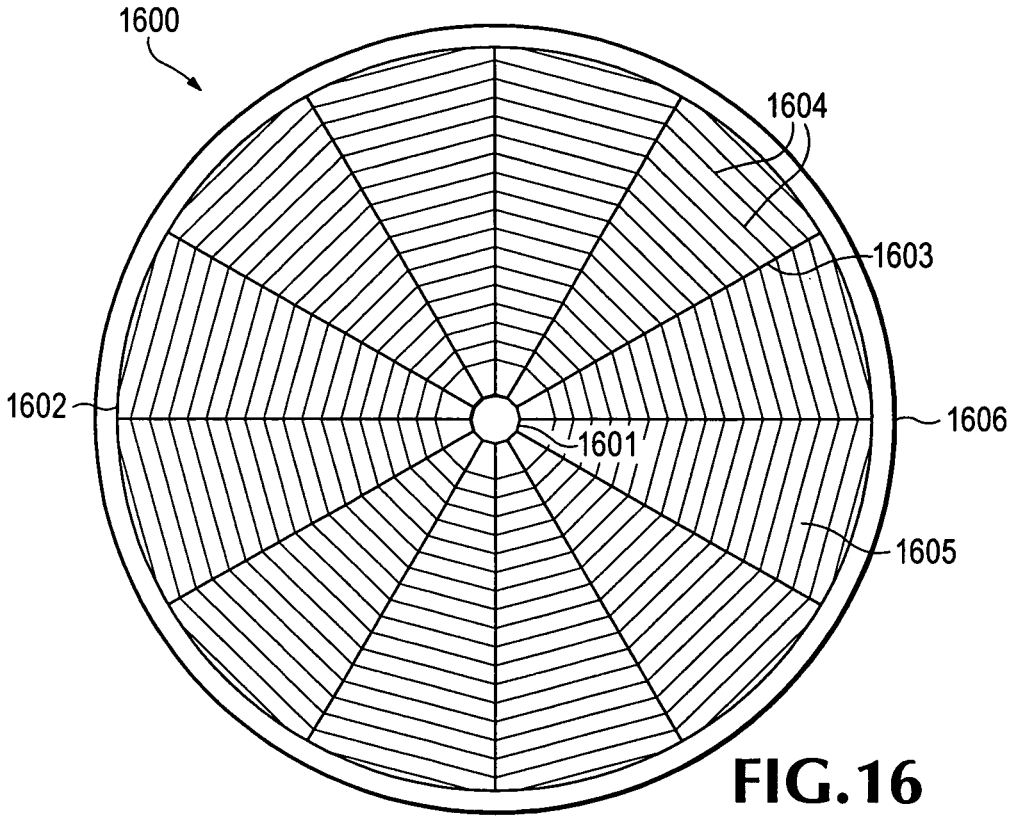

In a fifteenth variation, the CMP pad comprises features as illustrated in FIG. 15. In this variation, the CMP pad (1500) comprises a groove design center (1501), a pad edge (1506), a terminal groove (1502), primary grooves (1503), secondary grooves (1504), and sectors (1505). The groove pattern center (1501) may be grooveless as shown or have an alternate groove pattern as described above. Furthermore, the groove pattern center (1501) may be coincident with the center of the CMP pad (1500) or it may be offset. As shown in FIG. 15, the pad edge (1505) may be grooveless and the primary grooves (1503) may be logarithmic or linear toward the CMP pad center and logarithmic toward the CMP pad edge. In this instance, sectors (1505) are defined by the boundaries created by the groove design center (1501), the terminal groove (1502), and the primary grooves (1503). The "V-" shaped secondary grooves (1504) of the CMP pad (1500) transect the sectors (1505). As shown, vertices of the "V-" shaped secondary grooves (1504) point toward the center of the CMP pad (1500) and fall along a virtual primary groove equidistant from the sector-bounding primary grooves. The secondary grooves (1504), as shown, are matched (or on-set) from sector to sector; however, mismatched secondary grooves (1504) are also possible. The "V-" shaped secondary grooves (1504) of FIG. 15 provide another non-limiting example of a secondary groove based on a non-sinusoidal waveform (e.g., triangle wave).

In a sixteenth variation, the CMP pad comprises features as illustrated in FIG. 16. In this variation, the CMP pad (1600) comprises a groove design center (1601), a pad edge (1606), a terminal groove (1602), primary grooves (1603), linear secondary grooves (1604), and sectors (1605). The groove pattern center (1601) has straight line boundary lines positioned between the primary grooves (rather than the circular boundary lines of the groove pattern centers of the previous embodiments) and may be grooveless as shown or have an alternate groove pattern as described above. Furthermore, the groove pattern center (1601) may be coincident with the center of the CMP pad (1600) or it may be offset. As shown in FIG. 16, the pad edge (1605) may be grooveless and the primary grooves (1603) may be logarithmic or linear toward the CMP pad center and logarithmic or linear toward the CMP pad edge. In this instance, sectors (1605) are defined by the boundaries created by the groove design center (1601), the terminal groove (1602), and the primary grooves (1603). The linear shaped secondary grooves (1604) of the CMP pad (1600) transect the sectors (1605). The secondary grooves (1604), as shown, are matched (or on-set) from sector to sector; however, mis-matched secondary grooves (1604) are also possible. The "on-set linear" secondary grooves (1604) of FIG. 16 provide another non-limiting example of a secondary groove.).

The embodiments shown in FIGS. 9, 12, 13, 14, 15 and 16 also have some of the secondary grooves extending from a primary groove to the terminal groove or extending between two locations on the terminal groove. Accordingly, embodiments of the present invention are not limited to only secondary grooves extending from one primary groove to another primary groove, but may transect the sectors in other ways.

These novel groove configurations may be produced by any suitable method. For example, they may be produced using the in-situ methods described below, or they may be produced using ex-situ or mechanical methods, such as laser writing or cutting, water jet cutting, 3-D printing, thermoforming and vacuum forming, micro-contact forming, hot stamping or printing, and the like. The pads may also be sized or scaled as practicable to any suitable or desirable dimension. As described herein, typically the scaling of the pads is based upon the size of the wafer to be polished.

Methods for In-situ Grooving

In general, any suitable method of producing in-situ grooves on a CMP pad may be used. Unlike the current methods of ex-situ grooving, which are mainly mechanical in nature, the in-situ methods described herein may have several advantages. For example, the methods of in-situ grooving described herein will typically be less expensive, take less time, and require fewer manufacturing steps. In addition, the methods described herein are typically more useful in achieving the complex groove configurations. Lastly, the in-situ methods described herein are typically able to produce CMP pads having better tolerances (e.g., better groove depth, and the like).

In one variation, the methods for in-situ grooving comprise the use of a silicone lining placed inside a mold. The mold may be made of any suitable metal. For example, the mold may be metallic, made from aluminum, steel, ultramold materials (e.g., a metal/metal alloy having "ultra" smooth edges and "ultra" high tolerances for molding finer features), mixtures thereof, and the like. The mold may be any suitable dimension, and the dimension of the mold is typically dependent upon the dimension of the CMP pad to be produced. The pad dimensions, in turn, are typically dependent upon the size of the wafer to be polished. For example, illustrative dimensions for CMP pads for polishing a 4, 6, 8, or 12 inch wafer may be 12, 20.5, 24.6, or 30.5 inches respectively.

The silicone lining is typically made of a silicone elastomer, or a silicone polymer, but any suitable silicone lining may be used. The silicone lining is then typically embossed or etched with a pattern, which is complementary to the desired groove pattern or configuration. The lining is then glued or otherwise adhered to, or retained in, the mold. It should be noted that the lining may also be placed in the mold prior to it being patterned. The use of lithographic techniques to etch patterns into the silicone lining may help provide better accuracy in groove size. See, e.g., C. Dekker, Stereolithography tooling for silicone molding, Advanced Materials & Processes, vol. 161 (1), pp 59-61, January 2003; and D. Smock, Modern Plastics, vol. 75(4), pp 64-65, April 1998, which pages are hereby incorporated by reference in their entirety. For example, grooves in the micron to sub micron range may be obtained. Large dimensions in the mm range may also be obtained with relative ease. In this way, the silicone lining serves as the "molding pattern." However, in some variations, the mold may be patterned with a complementary groove design. In this way, the mold and the lining, or the mold itself, may be used to produce the CMP pad groove designs.

Using this method, the CMP pad can be formed from a thermoplastic or a thermoset material, or the like. In the case of a thermoplastic material, a melt is typically formed and injected into the mold. In the case of a thermoset material, a reactive mixture is typically fed into the mold. The reactive mixture may be added to the mold in one step, or two steps, or more. However, irrespective of the material used, the pad is typically allowed to attain its final shape by letting the pad material cure, cool down, or otherwise set up as a solid, before being taken out of the mold. In one variation, the material is polyurethane, and polyurethane pads are produced. In another variation, the material is poly (urethane-urea), and poly (urethane-urea) pads are produced. For example, polyurethane or poly (urethane-urea) pellets may be melted and placed into the silicone lined mold. The mold is etched with the desired groove pattern as described above. The polyurethane or poly (urethane-urea) is allowed to cool, and is then taken out of the mold. The pad then has patterns corresponding to those of the mold.

In many of the following methods, a large bun of, for example, polyurethane or poly (urethane-urea), may be sliced to form pad-shaped forms in which grooves are subsequently formed.

A. Laser Writing (Laser Cutting)

Laser writing or cutting may be used to make the novel groove configurations described herein. Laser cutters typically consist of a downward-facing laser, which is mounted on a mechanically controlled positioning mechanism. A sheet of material, e.g., plastic, is placed under the working area of the laser mechanism. As the laser sweeps back and forth over the pad surface, the laser vaporizes the material forming a small channel or cavity at the spot in which the laser hits the surface. The resulting grooves/cuts are typically accurate and precise, and require no surface finishing. Typically, grooving of any pattern may be programmed into the laser cutting machine. More information on laser writing may be found in J. Kim et al., J. Laser Applications, vol. 15(4), pp 255-260, November 2003, which pages are hereby incorporated by reference in their entirety.

B. Water Jet Cutting

Water jet cutting may also be used to produce the novel groove configurations described herein. This process uses a jet of pressurized water (e.g., as high as 60,000 pounds per square inch) to make grooves in the pad. Often, the water is mixed with an abrasive like garnet, which facilitates better tolerances, and good edge finishing. In order to achieve grooving of a desired pattern, the water jet is typically preprogrammed (e.g., using a computer) to follow desired geometrical path. Additional description of water jet cutting may be found in J. P. Duarte et al., Abrasive water jet, Rivista De Metalurgica, vol. 34(2), pp 217-219, March-April 1998, which pages are hereby incorporated by reference in their entirety.

C. 3-D Printing

Three Dimensional printing (or 3-D printing) is another process that may be used to produce the novel groove configurations described here. In 3-D printing, parts are built in layers. A computer (CAD) model of the required part is first made and then a slicing algorithm maps the information for every layer. Every layer starts off with a thin distribution of powder spread over the surface of a powder bed. A chosen binder material then selectively joins particles where the object is to be formed. Then a piston which supports the powder bed and the part-in-progress is lowered in order for the next powder layer to be formed. After each layer, the same process is repeated followed by a final heat treatment to make the part. Since 3-D printing can exercise local control over the material composition, microstructure, and surface texture, many new (and previously inaccessible) groove geometries may be achieved with this method. More information on 3-D printing may be found in Anon et al., 3-D printing speeds prototype dev., Molding Systems, vol. 56(5), pp 40-41, 1998, which pages are hereby incorporated by reference in their entirety.

D. Thermoforming and Vacuum Forming

Other processes that may be used to produce the novel groove configurations described herein are thermoforming and vacuum forming. Typically, these processes only work for thermoplastic materials. In thermoforming, a flat sheet of plastic is brought in contact with a mold after heating using vacuum pressure or mechanical pressure. Thermoforming techniques typically produce pads having good tolerances, tight specifications, and sharp details in groove design. Indeed, thermoformed pads are usually comparable to, and sometimes even better in quality than, injection molded pieces, while costing much less. More information on thermoforming may be found in M. Heckele et al., Rev. on micro molding of thermoplastic polymers, *J. Micromechanics and Microengineering*, vol. 14(3), pp R1-R14, March 2004, which pages are hereby incorporated by reference in their entirety.

Vacuum forming molds sheet plastic into a desired shape through vacuum suction of the warmed plastic onto a mold. Vacuum forming may be used to mold a specific thicknesses of plastic, for example 5 mm. Fairly complex moldings, and hence complex groove patterns, may be achieved with vacuum molding with relative ease.

E. Micro-contact Printing

Using micro contact printing (μCP), which is a high-resolution printing technique grooves can be embossed/printed on top of a CMP pad. This is sometimes characterized as "Soft Lithography." This method uses an elastomeric stamp to transfer a pattern onto the CMP pad. This method is a convenient, low-cost, non-photolithographic method for the formation and manufacturing of microstructures that can be used as grooves. These methods may be used to generate patterns and structures having feature sizes in the nanometer and micrometer (e.g., 0.1 to 1 micron) range.

F. Hot Stamping, Printing

Hot stamping can be used to generate the novel grooves designs describe here as well. In this process, a thermoplastic polymer may be hot embossed using a hard master (e.g., a piece of metal or other material that has a pattern embossed in it, can withstand elevated temperatures, and has sufficient rigidity to allow the polymer pad to become embossed when pressed into the hard master.) When the polymer is heated to a viscous state, it may be shaped under pressure. After conforming to the shape of the stamp, it may be hardened by cooling. Grooving patterns of different types may be achieved by varying the initial pattern on the master stamp. In addition, this method allows for the generation of nanostructures, which may be replicated on large surfaces using molding of thermoplastic materials (e.g., by making a stamp with a nano-relief structure). Such a nano-structure may be used to provide local grading/grooving on these materials that may be useful for several CMP processes. W. Spalte, Hot-stamping for surface-treatment of plastics, Kunsstoffe-German Plastics, vol. 76(12), pp 1196-1199, December 1986, which pages are hereby incorporated by reference in their entirety, provides more information on hot stamping.

What is claimed is:

1. A polishing pad for polishing a semiconductor substrate, the polishing pad comprising:

a polishing body having a polishing surface and a back surface, the polishing surface having a pattern of intersecting circumferential and linear radial grooves, the circumferential grooves comprising a plurality of concentric complete dodecahedrons.

2. The polishing pad of claim 1, wherein a center of the plurality of concentric complete dodecahedrons is located at a center of the polishing pad.

3. The polishing pad of claim 1, wherein a center of the plurality of concentric complete dodecahedrons is offset from a center of the polishing pad.

4. The polishing pad of claim 1, wherein the linear radial grooves do not intersect with one another.

5. The polishing pad of claim 1, wherein, distal from a center of the polishing pad, the linear grooves terminate before an outermost edge of the polishing pad.

6. The polishing pad of claim 5, wherein the linear grooves terminate at a circular, outermost, terminal groove.

7. The polishing pad of claim 1, wherein each of the circumferential and linear radial grooves has a width from about 2 to about 100 mils.

8. The polishing pad of claim 1, wherein the plurality of concentric complete dodecahedrons has a pitch from about 30 to about 1000 mils.

9. The polishing pad of claim 1, wherein the polishing pad is a molded polishing pad and the circumferential and linear radial grooves are in-situ circumferential and linear radial grooves.

10. The polishing pad of claim 1, wherein the circumferential and linear radial grooves intersect at vertices of each of the plurality of concentric complete dodecahedrons.

11. A polishing pad for polishing a semiconductor substrate, the polishing pad comprising:

a polishing body having a polishing surface and a back surface, the polishing surface having a pattern of intersecting circumferential and linear radial grooves, the circumferential grooves comprising a plurality of concentric complete polygons, wherein the circumferential and linear radial grooves intersect at vertices of each of the plurality of concentric complete polygons.

12. The polishing pad of claim 11, wherein a center of the plurality of concentric complete polygons is located at a center of the polishing pad.

13. The polishing pad of claim 11, wherein a center of the plurality of concentric complete polygons is offset from a center of the polishing pad.

14. The polishing pad of claim 11, wherein the linear radial grooves do not intersect with one another.

15. The polishing pad of claim 11, wherein, distal from a center of the polishing pad, the linear grooves terminate before an outermost edge of the polishing pad.

16. The polishing pad of claim 15, wherein the linear grooves terminate at a circular, outermost, terminal groove.

17. The polishing pad of claim 11, wherein each of the circumferential and linear radial grooves has a width from about 2 to about 100 mils.

18. The polishing pad of claim 11, wherein the plurality of concentric complete polygons has a pitch from about 30 to about 1000 mils.

19. The polishing pad of claim 1, wherein the polishing pad is a molded polishing pad and the circumferential and linear radial grooves are in-situ circumferential and linear radial grooves.

* * * * *